US008163067B2

(12) United States Patent
Garney et al.

(10) Patent No.: US 8,163,067 B2
(45) Date of Patent: Apr. 24, 2012

(54) APPARATUS AND PROCESS FOR ISOMERIZING A HYDROGEN STREAM

(75) Inventors: Bryan S. Garney, Crystal Lake, IL (US); Jocelyn C. Daguio, Chicago, IL (US); Kurt A. Detrick, Glen Ellyn, IL (US); Douglas A. Becci, Carol Stream, IL (US); David J. Shecterle, Arlington Heights, IL (US); John M. Krupczak, Hawthorn Woods, IL (US); Andrew D. Mezera, Des Plaines, IL (US)

(73) Assignee: UOP LLC, Des Plaines, IL (US)

( * ) Notice: Subject to any disclaimer, the term of this patent is extended or adjusted under 35 U.S.C. 154(b) by 374 days.

(21) Appl. No.: 12/485,233

(22) Filed: Jun. 16, 2009

(65) Prior Publication Data

US 2010/0314291 A1 Dec. 16, 2010

(51) Int. Cl.
*C10G 35/02* (2006.01)

(52) U.S. Cl. ..... 95/121; 95/117; 95/123; 95/126; 96/108; 96/150; 208/133

(58) Field of Classification Search ..... 95/90, 117, 95/121, 123, 126, 148; 96/108, 150; 208/133–141, 208/187–188
See application file for complete search history.

(56) References Cited

U.S. PATENT DOCUMENTS

| | | | | |
|---|---|---|---|---|
| 3,822,193 | A | 7/1974 | Chapman | |
| 3,967,464 | A | 7/1976 | Cormier et al. | |
| 4,008,058 | A | 2/1977 | Wischer et al. | |
| 4,324,936 | A | 4/1982 | Mikulicz | |
| 4,475,295 | A | 10/1984 | Hussmann | |
| 4,490,563 | A | 12/1984 | Van Pool et al. | |
| 5,082,989 | A | 1/1992 | Johnson | |
| 5,264,187 | A * | 11/1993 | Olbrich et al. | 422/612 |
| 5,350,442 | A | 9/1994 | Thelen et al. | |
| 5,744,684 | A | 4/1998 | Zinnen et al. | |
| 6,784,132 | B1 * | 8/2004 | Sechrist | 502/37 |
| 2010/0314291 | A1 | 12/2010 | Garney et al. | |
| 2010/0314292 | A1 | 12/2010 | Shecterle et al. | |

(Continued)

FOREIGN PATENT DOCUMENTS

DE 19713531 A1 10/1998

(Continued)

OTHER PUBLICATIONS

U.S. Appl. No. 12/485,246, filed Jun. 16, 2009, Garney et al.

(Continued)

*Primary Examiner* — Walter D Griffin
*Assistant Examiner* — Brian McCaig
(74) *Attorney, Agent, or Firm* — Maryann Maas

(57) ABSTRACT

One exemplary embodiment can be an apparatus for isomerizing a hydrocarbon stream rich in a C4 hydrocarbon and/or at least one of a C5 and C6 hydrocarbon. The apparatus can include: a first drier and a second drier adapted to receive a fluid including at least one reactant; and a reaction zone communicating with the first drier to receive the fluid including at least one reactant and with the second drier to receive the regenerant. Generally, the first drier operates at a first condition to dry the fluid including at least one reactant and the second drier operates at a second condition during regeneration with a regenerant. The regenerant is displaced from the drier using a down-flow regenerant displacement assembly.

20 Claims, 2 Drawing Sheets

U.S. PATENT DOCUMENTS

| | | | |
|---|---|---|---|
| 2010/0314293 | A1 | 12/2010 | Shecterle et al. |
| 2011/0064622 | A1 | 3/2011 | Garney |
| 2011/0065567 | A1 | 3/2011 | Garney |

FOREIGN PATENT DOCUMENTS

| | | | |
|---|---|---|---|
| FR | 1588860 | | 4/1970 |
| GB | 474976 | | 11/1937 |
| GB | 516566 | | 1/1940 |
| GB | 522988 | | 7/1940 |
| GB | 699773 | | 11/1953 |
| GB | 706045 | | 3/1954 |
| GB | 1100313 | | 1/1968 |
| GB | 1224929 | | 3/1971 |
| RU | 1806317 | A3 | 3/1993 |
| WO | WO 2007/106958 | A1 | 9/2007 |

OTHER PUBLICATIONS

U.S. Appl. No. 12/485,259, filed Jun. 16, 2009, Garney et al.
U.S. Appl. No. 12/163,593, filed Jun. 27, 2008, Garney et al.
U.S. Appl. No. 12/163,794, filed Jun. 27, 2008, Garney et al.
Robert A. Meyers, Chapter 9.2 UOP Butamer Process and Chapter 9.3 UOP Penex Process, Handbook of Petroleum Refining Processes, pp. 9.7-9.27, V3rd Ed., 2004.

* cited by examiner

APPARATUS AND PROCESS FOR ISOMERIZING A HYDROGEN STREAM

FIELD OF THE INVENTION

The field of this invention generally relates to an apparatus and a process for isomerizing a hydrocarbon stream.

DESCRIPTION OF THE RELATED ART

Isomerization of light paraffins is often conducted to increase the octane content of gasoline. Generally, such isomerization processes are conducted on separate light hydrocarbon fractions. As an example, isomerization of butane, or pentane and/or hexane (hereinafter may be abbreviated pentane-hexane) is undertaken in separate isomerization units to improve the gasoline quality. Typically, both the isomerization of butane or pentane-hexane are conducted in a fixed-bed liquid/vapor phase or vapor phase process. The reactor can receive a feed of the light paraffins mixed with a gas including a substantial amount of hydrogen.

In the isomerization of butane or pentane-hexane, water is a poison that can reduce the life expectancy of the reactor catalyst. As such, it is desirable to remove water before the hydrogen rich gas and/or the paraffin feed reaches the reactor. Consequently, typically both the feed and the gas are passed through separate drier units to remove water.

Often, two driers are utilized in either series or parallel with alternating regeneration operations, whether the fluid being processed is a gas rich in hydrogen or a hydrocarbon containing butane or pentane-hexane. As such, one drier can be in operation while the other drier may be regenerating. At the end of the regeneration, the drier can contain a gas regenerant if the drier is a gas drier, or a liquid regenerant if the drier is a hydrocarbon feed drier. Depending on the hydrocarbon fraction being isomerized, the regenerant can include mostly an isomerized product, such as isobutane, or at least one of isopentane and isohexane (hereinafter may be referred to as isopentane-isohexane); or the regenerant can include a mixture of one or more different branched, normal, and cyclic compounds. In either instance, generally the regenerant is flushed out of the drier before or as the regenerated drier enters into service. The regenerant may be removed from the system as a net stream.

The gas regenerant can cause upsets in the downstream vessels. Particularly, the gas regenerant can cause a drop in reaction temperatures as the regenerant replaces the hydrogen used in the reactor, and disrupts the hydrogen:hydrocarbon mole ratio in the reactor. In addition, generally the gas regenerant has a heavier molecular weight than the hydrogen rich gas. As a consequence, replacing the hydrogen rich gas may upset the gas flow controls, such as the make-up gas flow, as well as disturbing the pressure controls in a distillation column, which is typically used downstream of the reactor. Thus, there is a desire to lessen the impact after the regeneration of the gas drier to prevent upsets of the downstream vessels.

SUMMARY OF THE INVENTION

One exemplary embodiment can be an apparatus for isomerizing a hydrocarbon stream rich in a C4 hydrocarbon and/or at least one of a C5 and C6 hydrocarbon. The apparatus can include a first drier and a second drier adapted to receive a fluid including at least one reactant and a reaction zone communicating with the first drier to receive the fluid including at least one reactant and with the second drier to receive the regenerant. Generally, the first drier operates at a first condition to dry the fluid including at least one reactant and the second drier operates at a second condition during regeneration with a regenerant. The regenerant can pass through a down-flow regenerant displacement assembly for regulating the flow of the regenerant from the second drier.

Another exemplary embodiment can be a process for regenerating at least one drier for an apparatus for isomerizing a hydrocarbon stream rich in a C4 hydrocarbon and/or rich in at least one of a C5 and C6 hydrocarbon. The process can include regenerating the at least one drier containing a regenerant and displacing the regenerant from the at least one drier over a period of time and removing the displaced regenerant from the process to minimize upsets in downstream operations.

Yet another exemplary embodiment can be a process for regenerating at least one drying zone for an apparatus isomerizing a hydrocarbon stream. The process can include displacing a used regenerant rich in a C4 hydrocarbon and/or rich in at least one of a C5 and C6 hydrocarbon from the at least one drying zone over a period of time using a dried reactant fluid to minimize upsets in one or more downstream operations, and removing the displaced regenerant from the process.

Therefore, the embodiments disclosed herein can minimize upsets in operations downstream of a fluid drying zone by displacing a used regenerant from the drying zone and removing the displaced regenerant from the process. A down-flow regenerant displacement assembly is used to displace of the used regenerant with a dried fluid.

DEFINITIONS

As used herein, the term "stream" can be a stream including various hydrocarbon molecules, such as straight-chain, branched, or cyclic alkanes, alkenes, alkadienes, and alkynes, and optionally other substances, such as gases, e.g., hydrogen, or impurities, such as heavy metals, and sulfur and nitrogen compounds. The stream can also include aromatic and non-aromatic hydrocarbons. Moreover, the hydrocarbon molecules may be abbreviated C1, C2, C3 . . . Cn where "n" represents the number of carbon atoms in the hydrocarbon molecule. In addition, the term "Cn–Cn+1 hydrocarbon," such as "C5-C6 hydrocarbon," can mean at least one of a C5 and C6 hydrocarbon.

As used herein, the term "zone" can refer to an area including one or more equipment items and/or one or more sub-zones. Equipment items can include one or more reactors or reactor vessels, heaters, separators, exchangers, pipes, pumps, compressors, and controllers. Additionally, an equipment item, such as a reactor, drier or vessel, can further include one or more zones or sub-zones. It should be understood that each zone can include more equipment and/or vessels than depicted in the drawings.

As used herein, the term "down-flow regenerant displacement assembly" generally means a device made up of components that at least directly or indirectly regulates the flow or reduces the pressure of a fluid to a newly regenerated drier in a down-flow direction. Generally, a down-flow regenerant displacement assembly reduces a fluid flow as compared to its absence in e.g., a line, and may throttle a flow of fluid, as opposed to isolating the fluid. An exemplary down-flow regenerant displacement assembly can include at least one line upstream of the drier, having at least one control valve or restriction orifice (the control valve gives the added benefit of being able to gradually increase or decrease flow rate while the restriction orifice does not) and preferably at least one flow indicator, and one or more lines downstream of the drier, each having at least one valve. Paragraph [0028] further describes an exemplary embodiment.

As used herein, the term "fluid transfer device" generally means a device for transporting a fluid. Such devices include pumps typically for liquids, and compressors typically for gases.

As used herein, the term "rich" can mean an amount generally of at least about 50%, and preferably about 70%, by mole, of a compound or class of compounds in a stream.

As used herein, the term "substantially" can mean an amount generally of at least about 90%, preferably about 95%, and optimally about 99%, by mole, of a compound or class of compounds in a stream.

As used herein, the term "absorption" can refer to the retention of a material in a bed containing an absorbent and/or adsorbent by any chemical or physical interaction between a material, such as water, and the bed, and includes, but is not limited to, absorption, and/or adsorption. The removal of the material from an absorbent may be referred to herein as "desorption."

As used herein, the term "used regenerant" can refer to a regenerant that has been used for drying or desorbing, or that has been circulated through one or more vessels or equipment items, such as a drier. A used regenerant may or may not have desorbed a material, such as water, but may be present in a vessel after the vessel contents, such as a molecular sieve, have been regenerated.

As used herein, the term "coupled" can mean two items, directly or indirectly, joined, fastened, associated, connected, or formed integrally together either by chemical or mechanical means, by processes including stamping, molding, or welding. What is more, two items can be coupled by the use of a third component such as a mechanical fastener, e.g. a screw, a nail, a staple, or a rivet; an adhesive; or a solder.

DETAILED DESCRIPTION

Figure 1:
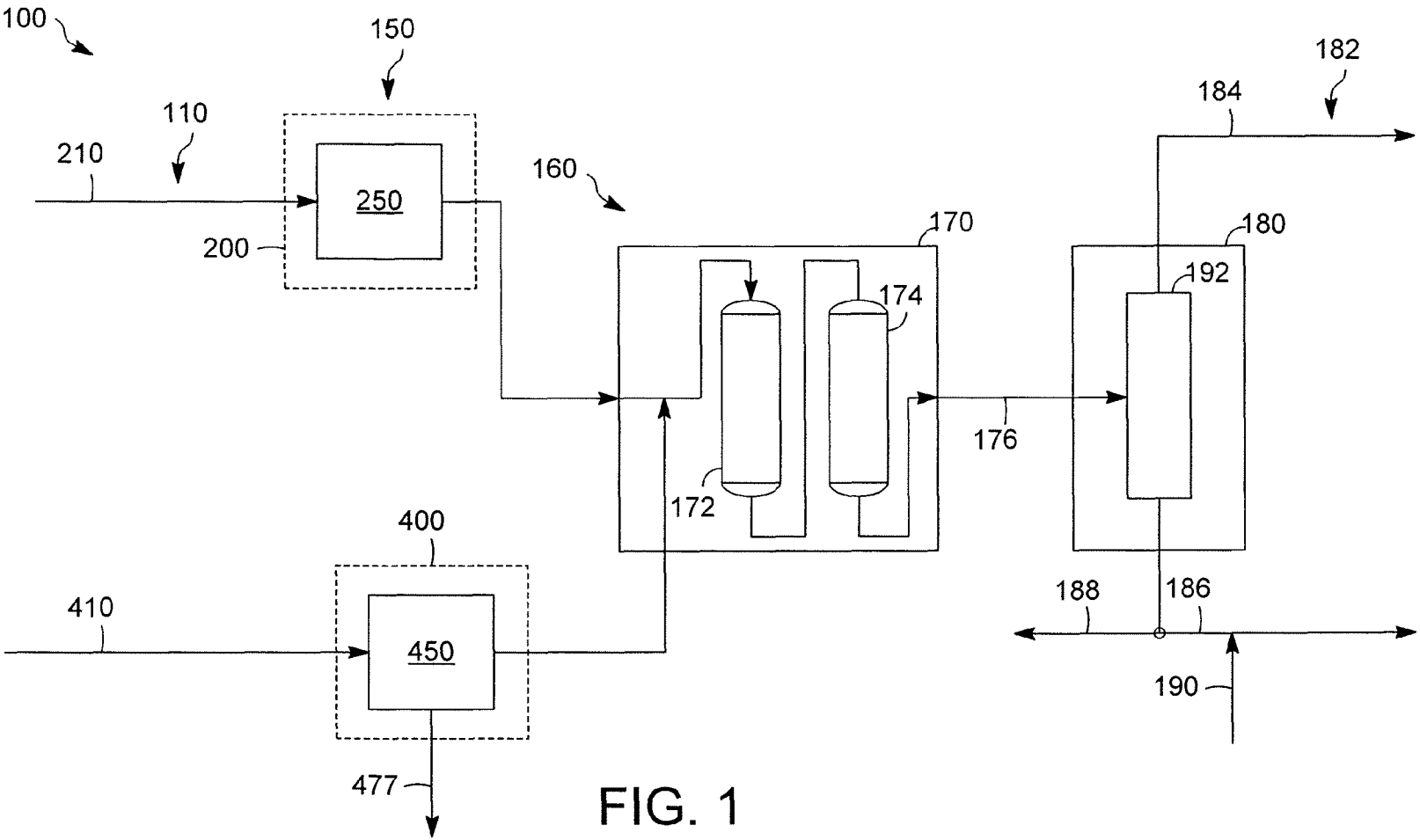
FIG. 1 is a schematic depiction of an exemplary apparatus for isomerizing a fluid.

An apparatus 100 for isomerizing a hydrocarbon stream is depicted in FIG. 1. Generally, the apparatus 100 can receive a fluid including at least one reactant 110 in either a line 210 or a line 410. Usually, the fluid 110 can be a liquid hydrocarbon stream in the line 210 or a gas rich in hydrogen in the line 410. The liquid hydrocarbon stream can be rich in a C4 hydrocarbon, such as butane, if the apparatus 100 is a C4 isomerization apparatus. Alternatively, the liquid hydrocarbon stream can be rich in a C5-C6 hydrocarbon, such as pentane-hexane, if the apparatus 100 is a C5-C6 isomerization apparatus. Exemplary apparatuses of both types are disclosed in, e.g., Nelson A. Cusher, *UOP Butamer Process* and *UOP Penex Process* of the Handbook of Petroleum Refining Processes, Third Edition, Robert A. Meyers, Editor, 2004, pp. 9.7-9.27. However, the apparatus 100 may also be utilized for simultaneously isomerizing a stream of one or more butanes, one or more pentanes, and one or more hexanes in some exemplary embodiments. Note that the isomerization reactions include those having largely normal paraffins as feedstock and branched paraffins as isomerate product as well as those having largely branched paraffins as feedstock and normal paraffins as isomerate product. In other words, the liquid hydrocarbon stream can be rich in isobutane or branched C5-C6 hydrocarbon. Other isomerization reactions involving the C4 or C5-C6 hydrocarbons are within the scope of the invention as well.

To simplify the discussion below, terms such as "liquid hydrocarbon" and "regenerant" may be referred to generically and should be understood to be applicable to, e.g., either a C4 isomerization apparatus or a C5-C6 isomerization apparatus. As an example, a hydrocarbon stream rich in a C4 hydrocarbon can be isomerized in a C4 isomerization reactor and an isomerized C4 hydrocarbon product can be used as a regenerant in a C4 isomerization apparatus. Likewise, a hydrocarbon stream rich in a C5-C6 hydrocarbon can be isomerized in a C5-C6 isomerization reactor, and an isomerized C5-C6 hydrocarbon product can be used as a regenerant in a C5-C6 isomerization apparatus. However, it remains within the scope of the invention to use a regenerant stream from one or more different locations of the isomerization process such as the from a fractionation zone, from driers, or perhaps even from a location external to the isomerization process. Nitrogen, for example, from a source external to the isomerization process may be used as the regenerant.

The apparatus 100 can include one or more drying zones 150, such as a liquid drying zone 250 and a gas drying zone 450, and one or more downstream operations 160, such as a reaction zone 170 and a fractionation zone 180. The liquid drying zone 250 can be comprised in a first fluid drying unit 200, and the gas drying zone 450 can be comprised in a second fluid drying unit 400. Unit 400 is discussed in further detail hereinafter. The liquid drying zone 250 can receive a liquid hydrocarbon stream from the line 210, and the gas drying zone 450 can receive a gas rich in hydrogen from the line 410. Although not shown, it should be understood that fluid transfer devices, such as pumps and compressors, can be used to transport, respectively, the hydrocarbon liquid stream and the gas rich in hydrogen. Alternatively, either fluid can be of sufficient pressure so as to not require such devices. After exiting the drying zones 250 and 450, the liquid hydrocarbon stream and the gas rich in hydrogen may be combined downstream of the drying zones 250 and 450 in, e.g., the reaction zone 170.

The one or more downstream vessels 160 can be segregated into the reaction zone 170, which can include a first reactor 172 and a second reactor 174 in series with the first reactor 172, and the fractionation zone 180, which can include one or more distillation columns 192. Although only the first reactor 172 and second reactor 174 are depicted, it should be understood that the reaction zone 170 can further include other equipment or vessels, such as one or more heaters, a recycle gas compressor, a separator vessel, and additional reactors. Alternatively, the reactors 172 and 174 can be placed in single operation. An effluent from the reaction zone 170 can pass through a line 176 to the fractionation zone 180.

The fractionation zone 180 can include one or more distillation columns 192. Although one distillation column 192 is depicted, two or more distillation columns may be operated in series and/or in a parallel. The distillation column 192 can produce one or more separated products 182, such as a first product of one or more gas products routed to, e.g., fuel gas, in a line 184 and a second product or isomerized product in a line 186. A portion of the second product can be withdrawn through a line 188 and used as a regenerant. Used regenerant can be returned to the isomerized product in a line 190, as hereinafter described. The combined stream can be sent to an isomerized product storage tank, a distillation column, or another process unit.

Figure 2:
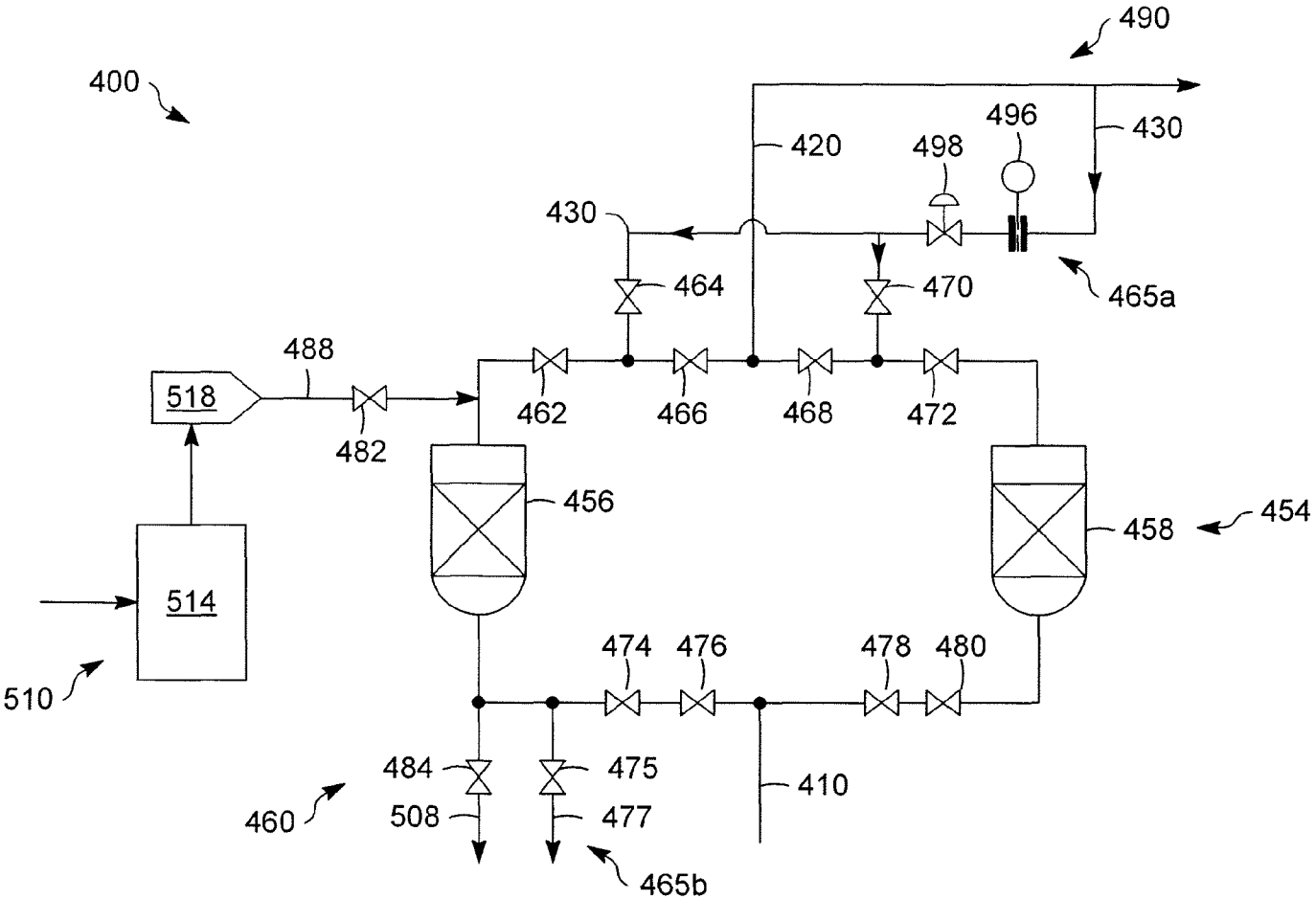
FIG. 2 is a schematic depiction of an exemplary gas fluid drying unit.

The gas fluid drying unit 400 is depicted in FIG. 2. The gas fluid drying unit can be used to dry a gas stream, such as a gas stream rich in hydrogen. Usually, the gas fluid drying unit 400 includes at least one drier 454, one or more valves 460, a down-flow regenerant displacement assembly 465*a* and 465*b* and a heater 510. Generally, the at least one drier 454 includes a first gas drier 456 and a second gas drier 458. The driers 456 and 458 can be comprised in the gas drying zone 450 as depicted in FIG. 1. Moreover, each drier 456 and 458 can contain a molecular sieve where absorption and/or adsorption of water and other undesirable compounds such as carbon dioxide and hydrogen sulfide occurs and include a respective internal drying zone or sub-zone. Generally, each drier 456 and 458 operates at a first condition to dry the gas rich in hydrogen passing through the drier and a second condition to regenerate the drier. The driers 456 and 458 can be in series and regenerate alternatively with the other drier drying.

The one or more valves 460 can include a valve 462, a valve 464, a valve 466, a valve 468, a valve 470, a valve 472, a valve 474, a valve 476, a valve 478, a valve 480, a valve 482, a valve 484, a valve 475, and a valve 498. Various combinations of valves 460 can be opened and closed to direct process streams for conducting the first and second conditions.

In this exemplary embodiment, the down-flow regenerant displacement assembly, comprising both 465*a* and 465*b*, can include equipment such as a flow indicator 496, a control valve 498, a line 430, a valve 464, a valve 475, and a line 477. Particularly, the flow indicator 496 can be in communication with the control valve 498, and the flow indicator 496, the control valve 498, and the valve 464 can be coupled to a line 430, thus comprising 465*a*. In addition, the valve 475 can be coupled to the line 477, thus comprising 465*b*. The heater 510 can include a steam heater 514 and a superheater 518.

In one exemplary regeneration operation, the gas, such as a gas rich in hydrogen, is typically introduced through a line 410. In this example, the drier 458 is in a first condition drying a fluid while the drier 456 is in the second condition being regenerated. As such, the gas can enter the line 410 and pass through valves 478 and 480 into the first drier 458, and the valves 474 and 476 may be closed. Typically, the valves 466 and 470 are also closed during drying of the gas in the drier 458. Afterwards, the dried gas can pass through the valves 472 and 468 and through the first line 420 to the reaction zone 170 as depicted in FIG. 1.

Meanwhile, the second gas drier 456 is being regenerated. Generally, the regeneration is a multiple stage process using a liquid regenerant from the line 188 of FIG. 1, which may be passed to the heater 510. During regeneration, the regenerant may be heated in stages with the steam heater 514 and then with both the steam heater 514 and the superheater 518 until the regenerant is of sufficient temperature to desorb water from the molecular sieve. Generally, the regenerant passes through the steam heater 514 and the superheater 518 through a line 488 and the valve 482, and to the top of the gas drier 456. Subsequently, the regenerant may pass through the drier 456, through the valve 484, and a line 508 before being cooled with e.g., a cooling water exchanger, to return in the line 190 as depicted in FIG. 1. Typically, the valves 462, 475, 474 and 476 are closed.

Afterwards, the regenerant can be slowly cooled by first turning off the superheater 518 while continuing to vaporize and heat the regenerant in the steam heater 514 and continually passing the regenerant through the drier 456. Thus, the drier 456 and associated equipment can be cooled to slowly ramp down the temperatures. At the end of the regeneration process, the drier 456 generally contains the used regenerant as a gas.

After the regeneration process is complete, the used regenerant can be displaced from the drier 456 through the opened valve 475 and through the line 477 using the down-flow regenerant displacement assembly 465*a* and 465*b*. Using 465*a*, a portion of the dried gas rich in hydrogen in line 420 is passed through the flow indicator 496, control valve 498, opened valve 464, line 430, and opened valve 462. Using 465*b*, displaced regenerant is passed through valve 475 and removed from the process via line 477. The displacement of the used regenerant is conducted in a way to minimize upsets in one or more downstream operations, particularly in the reaction zone 170 and the fractionation zone 180. For example, control valve 498 can be sized to regulate the flow rate of the dried gas rich in hydrogen. This rate can be calculated based on a desired period of time to ensure complete displacement of the used regenerant without excessively delaying operations and without upsetting downstream operations. Also, control valve 498 may be opened in a controlled manner so that the flow rate of dried gas in line 430 gradually increases to reach a target flow rate. Again, gradually increasing the flow rate of dried gas in line 430 helps to avoid upsets in downstream operations such as the reaction zone or the fractionation zone. After the preset time period for displacement of the regenerant, operations can be switched by closing the valves 464 and 475, opening the valves 466, 474, 476, and closing the valves 468, 472, 478, and 480 so that the drier 456 dries the gas. At this point, the drier 458 is in condition for regeneration. Again, at the end of the used regenerant displacement stage, the flow rate of dried gas in line 430 may be ramped down gradually using control valve 498 so as to minimize upsets in downstream operations.

Although drying and regenerating of respective driers 458 and 456 are discussed herein, it should be understood that additional piping and/or valves can be included so that each drier 456 and 458 can operate in both conditions of drying and regenerating, and series operation. As an example, the driers 456 and 458 can be placed back in series operation with, e.g., the drier 456 in a lag position with respect to the drier 458, after regeneration.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing, all temperatures are set forth uncorrected in degrees Celsius and, all parts and percentages are by mole, unless otherwise indicated.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. An apparatus for displacing regenerant from a drier, comprising: a first drier and a second drier adapted to receive a gaseous fluid comprising at least one reactant wherein the first drier operates at a first condition to dry the fluid comprising at least one reactant and the second drier operates at a second condition during regeneration with a regenerant; a reaction zone communicating via a first line with the first drier to receive the gaseous fluid comprising at least one reactant; and a down-flow regenerant displacement assembly adapted to conduct, and to regulate the flow or reduce the pressure of, a portion of the gaseous fluid to the second drier, to conduct displaced regenerant away from the second drier and downstream operations to minimize upsets.

2. The apparatus of claim 1 wherein the apparatus for displacing regenerant from a drier is a portion of an apparatus for isomerizing a hydrocarbon stream rich in a C4 hydrocarbon and/or at least one of a C5 and C6 hydrocarbon.

3. The apparatus according to claim 2, wherein the reaction zone comprises at least one C4 isomerization reactor.

4. The apparatus according to claim 2, wherein the reaction zone comprises at least one C5 and/or C6 isomerization reactor.

5. The apparatus according to claim 2, further comprising: a fractionation zone comprising one or more distillation columns, receiving an effluent from the reaction zone and producing one or more separated products; and sending at least a portion of one of the separated products as the regenerant to at least one of the first and second driers.

6. The apparatus of claim 1 wherein the down-flow regenerant displacement assembly comprises a second line communicating the second drier with the first line wherein the second line is equipped with a flow indicator, a restriction orifice or a control valve, and a valve; a third line communicating with the second drier wherein the third line is equipped with a valve; and wherein the second line communicates with the second drier at a location, A, and the third line communicates with the second drier at a location, B, so that regenerant is displaced from the second drier in a down-flow mode.

7. The apparatus according to claim 1, further comprising a heater to heat the regenerant before the regenerant enters one of the driers being regenerated.

8. The apparatus according to claim 1, wherein the first and second driers contain a molecular sieve.

9. The apparatus according to claim 1, wherein the displaced regenerant is conducted away from the reaction zone.

10. The apparatus according to claim 9, further comprising a fractionation zone and the displaced regenerant is conducted away from the fractionation zone.

11. An apparatus for displacing regenerant, comprising:

a first drier and a second drier;

a down-flow regenerant displacement assembly;

a reaction zone downstream of the first drier and second drier; and a fractionation zone downstream of the reaction zone; wherein the first drier and second drier are adapted to receive a gaseous fluid comprising at least one reactant, and the first drier operates at a first condition to dry the fluid comprising at least one reactant and the second drier operates at a second condition during regeneration with a regenerant, and the down-flow regenerant displacement assembly, upon completion of regeneration, is adapted to provides the gaseous fluid to conduct the regenerant away from the second drier and downstream operations to minimize upsets.

12. The apparatus according to claim 11, wherein the downstream operations comprise the reaction zone and the fractionation zone.

13. The apparatus according to claim 11, wherein the reaction zone is an isomerization reaction zone.

14. The apparatus according to claim 11, wherein the first drier and the second drier contain a molecular sieve.

15. The apparatus according to claim 11, wherein the down-flow regenerant displacement assembly comprises a line equipped with a flow indicator, a restriction orifice or a control valve, and a valve.

16. The apparatus according to claim 15, wherein the down-flow regenerant displacement assembly further comprises another line equipped with a valve and communicating with the second drier.

17. An apparatus for displacing regenerant, comprising:

a first drier and a second drier;

a down-flow regenerant displacement assembly;

a reaction zone downstream of the first drier and second drier; and a fractionation zone downstream of the reaction zone; wherein the first drier and second drier are adapted to receive a gaseous fluid comprising at least one reactant, and the first drier operates at a first condition to dry the fluid comprising at least one reactant and the second drier operates at a second condition during regeneration with a regenerant, and the down-flow regenerant displacement assembly, upon completion of regeneration, is adapted to provides the gaseous fluid to conduct the regenerant away from the second drier, and the reaction zone and the fractionation zone to minimize upsets.

18. The apparatus according to claim 17, wherein the first drier and the second drier contain a molecular sieve.

19. The apparatus according to claim 17, wherein the down-flow regenerant displacement assembly comprises a line equipped with a flow indicator, a restriction orifice or a control valve, and a valve.

20. The apparatus according to claim 19, wherein the down-flow regenerant displacement assembly further comprises another line equipped with a valve and communicating with the second drier.

* * * * *